US007824527B2

(12) United States Patent
Vandenborre

(10) Patent No.: US 7,824,527 B2
(45) Date of Patent: Nov. 2, 2010

(54) FRAME FOR ELECTROLYSER MODULE AND ELECTROLYSER MODULE AND ELECTROLYSER INCORPORATING SAME

(76) Inventor: Hugo Jan Baptist Vandenborre, Grootreesdigjk 61, Kasterlee (BE) B-2460

( * ) Notice: Subject to any disclaimer, the term of this patent is extended or adjusted under 35 U.S.C. 154(b) by 746 days.

(21) Appl. No.: 10/577,529

(22) PCT Filed: Oct. 29, 2004

(86) PCT No.: PCT/EP2004/012354

§ 371 (c)(1),
(2), (4) Date: Mar. 15, 2007

(87) PCT Pub. No.: WO2005/049894

PCT Pub. Date: Jun. 2, 2005

(65) Prior Publication Data

US 2007/0215492 A1 Sep. 20, 2007

(30) Foreign Application Priority Data

Oct. 30, 2003 (EP) ..... 03078415

(51) Int. Cl.
*C25B 9/02* (2006.01)
*C25B 9/18* (2006.01)
*C25B 9/20* (2006.01)

(52) U.S. Cl. ..... 204/279; 204/286.1; 204/297.01; 204/275.1; 204/278; 204/258

(58) Field of Classification Search ..... 204/279, 204/286.1, 297.01, 278, 275.1, 258
See application file for complete search history.

(56) References Cited

U.S. PATENT DOCUMENTS

| | | | |
|---|---|---|---|
| 2,075,688 | A | 3/1937 | Zdansky et al. |
| 2,717,872 | A | 9/1955 | Zdansky |
| 3,749,604 | A | 7/1973 | Langer |
| 3,817,772 | A | 6/1974 | Heit |
| 3,861,963 | A | 1/1975 | Afrance et al. |

(Continued)

FOREIGN PATENT DOCUMENTS

| | | |
|---|---|---|
| CA | 1031292 | 5/1978 |

(Continued)

OTHER PUBLICATIONS

Vandenborre et al., "Developments on IME-Alkaline Water Electrolysis", Int. J. Hydrogen Energy, 8(2), 81-83 (1983).

(Continued)

*Primary Examiner*—Bruce F Bell

(57) ABSTRACT

The present invention is directed to a frame for an electrolyser module as well as to an electrolyser module and an electrolyser incorporating such frames. The frames include a variety body having at least one electrolyser chamber opening and at least one degassing chamber defined therein. The degassing chamber opening preferably has a rounded shape as does the unitary body and the electrolyser chamber opening.

66 Claims, 7 Drawing Sheets

U.S. PATENT DOCUMENTS

| | | | | |
|---|---|---|---|---|
| 3,890,417 | A | 6/1975 | Vallance | |
| 3,960,698 | A | 6/1976 | Bortak | |
| 4,017,375 | A | 4/1977 | Pohto | |
| 4,031,001 | A | 6/1977 | Bosa | |
| 4,051,009 | A | 9/1977 | Schweickart et al. | |
| 4,072,793 | A | 2/1978 | Watanabe | |
| 4,168,221 | A | 9/1979 | Kadija et al. | |
| 4,197,178 | A | 4/1980 | Pellegri et al. | |
| 4,214,969 | A | 7/1980 | Lawrance | |
| 4,250,114 | A | 2/1981 | Biller | |
| 4,274,939 | A | 6/1981 | Bjaareklint | |
| 4,279,731 | A | 7/1981 | Pellegri | |
| 4,339,322 | A | 7/1982 | Balko et al. | |
| 4,371,596 | A | 2/1983 | Sheibley | |
| 4,415,424 | A | 11/1983 | Pere | |
| 4,482,441 | A | 11/1984 | Indeherbergh et al. | |
| 4,505,789 | A | 3/1985 | Ford | |
| 4,605,323 | A | 8/1986 | Blanchard | |
| 4,605,482 | A | 8/1986 | Shiragami et al. | |
| 4,606,805 | A | 8/1986 | Bon | |
| 4,698,143 | A | 10/1987 | Morris et al. | |
| 4,758,322 | A | 7/1988 | Sioli | |
| 5,130,008 | A * | 7/1992 | Cabaraux et al. | 204/283 |
| 5,139,635 | A * | 8/1992 | Signorini | 204/256 |
| 5,203,972 | A | 4/1993 | Shimamune et al. | |
| 5,425,863 | A * | 6/1995 | Chiti | 204/229.8 |
| 5,425,864 | A * | 6/1995 | Botte | 204/237 |
| 5,690,797 | A | 11/1997 | Harada et al. | |
| 5,783,051 | A | 7/1998 | Hirai et al. | |
| 5,837,110 | A | 11/1998 | Dean | |
| 6,080,290 | A | 6/2000 | Stuart et al. | |
| 6,309,521 | B1 | 10/2001 | Andrews et al. | |
| 6,338,786 | B1 | 1/2002 | Thorpe et al. | |
| 6,375,812 | B1 | 4/2002 | Leonida | |
| 6,474,330 | B1 | 11/2002 | Fleming et al. | |
| 6,554,978 | B1 * | 4/2003 | Vandenborre | 204/258 |
| 2009/0229990 | A1 * | 9/2009 | Hinatsu et al. | 205/334 |
| 2010/0012503 | A1 * | 1/2010 | Hinatsu et al. | 205/628 |

FOREIGN PATENT DOCUMENTS

| | | |
|---|---|---|
| CA | 2379018 | 2/2001 |
| CA | 2520486 | 10/2004 |
| CH | 107000 | 10/1924 |
| DE | 869941 | 3/1953 |
| EP | 0056759 | 7/1982 |
| EP | 0232923 | 8/1987 |
| EP | 0137836 | 9/1989 |
| EP | 0427340 | 5/1991 |
| EP | 0995818 | 4/2000 |
| EP | 1133586 | 7/2002 |
| EP | 1528126 | 5/2005 |
| GB | 1547581 | 6/1979 |
| JP | 08-260176 | 10/1996 |
| JP | 10-299576 | 11/1998 |
| WO | WO 94/00620 | 1/1994 |
| WO | WO 95/17771 | 6/1995 |
| WO | WO 97/00979 | 1/1997 |
| WO | WO 97/24778 | 7/1997 |
| WO | WO 98/32900 | 7/1998 |
| WO | WO 2004/087997 | 10/2004 |
| WO | WO 2006/060912 | 6/2006 |

OTHER PUBLICATIONS

Vandenborre et al., "A Survey of Five Tear Intensive R&D Work in Belgium on Advanced Alkaline Water Electrolysis", Int. J. Hydrogen Energy, 9(4), 277-284 (1984).

Vandenborre et al., "Advanced Alkaline Water Electrolysis using Inorganive Membrane (I.M.E.) Technology", Int. J. Hydrogen Energy, 10(11), 719-729 (1985).

Patent Abstracts of Japan, vol. 6, No. 119 (E-116)(997], Jul. 3, 1982; & JP-A-57 46 465 (Furukawa Denki Kogyo K.K.) Mar. 16, 1982.

Chemical Abstracts, vol. 83, No. 22, Dec. 1, 1975, p. 188, abstract No. 182070s, Columbus Ohio, U.S.; & JP-A-75 64 739 (Tokyo Shibaura Electric Co., Ltd) Feb. 6, 1975.

Patent Abstracts of Japan, vol. 6, No. 176 (E-130)(1054], Sep. 10, 1982; & JP-A-57 95 071 (Fujikura Densen K.K.) Dec. 6, 1982.

Chemical Abstracts, vol. 83, No. 8, Aug. 25, 1975, p. 120, abstract No. 60886s, Columbus Ohio, US; & IN-A-109 715 (India Ministry of Defense) Sep. 11, 1968.

* cited by examiner

FRAME FOR ELECTROLYSER MODULE AND ELECTROLYSER MODULE AND ELECTROLYSER INCORPORATING SAME

FIELD OF THE INVENTION

The present invention concerns electrolysers and in particular frames that may be connected together to form electrolyser modules and electrolysers.

BACKGROUND OF THE INVENTION

Electrolysers of the filter-press type comprise a so-called electrolyser module and a number of peripheric components such as degassing chambers, a water supply unit and possibly a transformer/rectifier and the necessary piping to connect the various parts of the electrolyser. An electrolyser module comprises a series of stacked electrolysis chambers, alternately cathodic and anodic. Each chamber holds either one or more anodes or cathodes. The electrolysis chambers are separated from one another by selectively permeable membranes or diaphragms. A combination of a cathodic and an anodic chamber form an electrolysis unit cell. In each chamber, the electrodes are mounted vertically, preferably in close contact with the membranes. This can be accomplished, for example, by pressing the membrane between the electrodes. In preferred executions, perforated electrodes are used. Membranes that are particularly suited for this purpose have been described in EP-A-0 232 923.

The electrolysis chambers are held together by a frame, which forms the outer wall of the electrolyser and may take a variety of shapes, e.g. polygonal such as square, rectangular, or circular. In the last-mentioned instance the frame is in fact ring or cylinder shaped. The separating membrane is fixed to the frame together with the electrodes. The frames are made of a material that is inert to the electrolyte and can be made for example of metal, covered by a suitable non-conducting layer, or can be made of a suitable inert non-conducting material such as a synthetic, preferably polymeric material. A frame made of metal covered by a flexible vulcanizable material is known from WO-97/00979.

A single holding frame from a unit cell has a central opening, which forms the interior of an electrolysis chamber. Typically this opening is circular although it may also have other shapes. The size and shape of this central opening as well as any other openings is the same in all holding frames of the electrolyser module. A holding frame usually also has one or two circular openings for the electrolyte (which may be an aqueous potassium hydroxide solution) and one opening for the produced gas to escape. The frames are arranged in such manner that the openings are adjacent to one another thus forming a conduit.

The active cell area is defined as the area, which is exposed to the electrolyte liquid held in the anodic or cathodic chamber. The active cell area is determined by the size of the central opening of the holding frames.

In each electrolysis chamber the electrodes have to be linked by a suitable conductor. In particular embodiments this can be accomplished by contacting the electrode with a metal woven sheet, which in turn is contacted with a metal plate that is mounted in the frame, said plate being referred to in the art as the bipolar plate.

The electrolyser module therefore is composed of unit cells put electrically in series and hydraulically in parallel through the above mentioned frames and are tied together using tie-rods.

The gas that is generated is led to a degassing chamber, which mainly functions as a gas/liquid separator, for example based on the decantation principle, which is mounted on top of the electrolyser module. The degassing chambers typically are cylinder type vessels that are physically separated from the cell stack, where the gas is collected and separated off the electrolyte entrained with the gas. They can be positioned in parallel as well as perpendicular to the electrolyser module.

The de-gassed electrolyte is recycled back to the electrolysis chambers and the gas that is collected can be pressurized and stored in suitable pressure tanks.

The electrolysis chambers may be connected to outer tubes leading to or coming from the de-gassing chamber for respectively the circulation of the generated gasses or of electrolyte. Or the electrolysis chamber holding frames may have suitable conduits at their top side and at their bottom side. The top conduit is meant to evacuate the gas-electrolyte mixture that is generated during electrolysis and the bottom conduit allows the entrance of water or electrolyte.

The gas-electrolyte mixture that is generated is pumped through the upper conduit to a tube leading to the de-gassing unit from which the de-gassed electrolyte is pumped back to the bottom conduit in the frame from which it enters the electrolysis chambers.

Filter-press electrolysers have been described in EP-A-137,836 and in EP-A-56,759.

U.S. Pat. No. 5,139,635 for example describes gas electrolysers of the filter-press type comprising a vertical stack of electrolysis chambers connected to a degassing chamber.

EP 1133586 describes a high pressure electrolyser module having frames of special design that allow the electrolyser module to function at high pressure thus avoiding an additional gas-compression step so that the formed gas can be directly stored.

Hence the art-known gas electrolysers of the filter-press type are quite large and complex arrangements involving several peripheral items such as pumps, tanks and piping, and therefore comprise a multitude of moving parts, requiring supervision, checking and maintenance. Thus, a more simplified and compact arrangement with no or fewer moving parts would be a desirable goal to achieve in that it would require almost no or limited maintenance.

The compact electrolysers according to the present invention are aimed at avoiding moving parts and at the same time allowing the elimination of peripheral equipment resulting in a more simplified arrangement of the electrolyser, requiring less supervision and maintenance.

In the present invention, one holding frame includes the gas/liquid separator as well as the active unit cell area. The latter offers not only great economic advantage with respect to reduced manufacturing as well as material costs, but moreover results in a substantially more compact overall electrolysis module.

SUMMARY OF THE INVENTION

Thus in one aspect the present invention concerns a holding frame for an electrolyser module, said frame having an opening that forms an electrolysis chamber, characterized in that the frames have one or more additional openings that form one or more degassing chambers, wherein the gas that is generated is collected and allowed to separate into a liquid and gas phase.

The said additional openings in fact form one or more internal degassing chambers, allowing a more compact and simple design of the electrolyser module.

In preferred embodiments, the holding frame additionally has one or more openings that form conduits for the supply of electrolyte and water In preferred embodiments, the holding frame has two additional openings that form conduits for the removal of the gasses that are separated off in the internal degassing chambers.

In a further aspect, the present invention concerns an electrolyser module comprising a series of stacked electrolysis chambers and each chamber being held within two holding frames, wherein the frames are as described in this specification and claims.

The electrolyser may function as a low pressure or as a high pressure electrolyser module.

Thus in a further aspect, the present invention concerns a ring-shaped holding frame for a high pressure electrolyser module, said frame having one or more openings that form conduits for the supply of electrolyte said frames having openings that form conduits for the supply of electrolyte and water, wherein (1) the connecting surface of the ring-shaped frame has one or more elevations and/or one or more depressions in such manner that an elevation of a ring fits in a depression of a neighboring ring; (2) a gasket is placed in between said elevation in a particular ring and said depression of a neighboring ring; (3) the distance between the rim of said conduit and the outer wall of the opening forming the gas or electrolyte conduit, and the outer wall of the ring-shaped frame is such that the material can endure a pressure gradient of at least 200 bar and characterized in that the frames have one or more additional openings that form one or more degassing chambers, wherein the gas that is generated is collected and allowed to separate into a liquid and gas phase.

The present invention furthermore concerns a high pressure electrolyser module comprising a series of stacked electrolysis chambers and each chamber being held within two ring-shaped holding frames, wherein the frames are as described in this specification and claims.

Thus in a further aspect there is provided a high pressure electrolyser module comprising a series of stacked electrolysis chambers and each chamber being held within two ring-shaped holding frames, said frames having openings that form conduits for the supply of electrolyte and the removal of gas that is generated, wherein (1) the connecting surface of the ring-shaped frame has one or more elevations and/or one or more depressions in such manner that an elevation of a ring fits in a depression of a neighboring ring; (2) a gasket is placed in between said elevation in a particular ring and said depression of a neighboring ring; (3) the distance between the rim of said conduit and the outer wall of the opening forming the gas or electrolyte conduit, and the outer wall of the ring-shaped frame is such that the material can endure a pressure gradient of at least 200 bar and characterized in that the frames have one or more additional openings that form one or more degassing chambers, wherein the gas that is generated is collected and allowed to separate into a liquid and gas phase.

Thus in this further aspect the invention provides an electrolyser which functions under high pressure thus yielding gasses that are under increased pressure and that can be stored directly, without the extra step of compressing.

In a further aspect, the high pressure electrolysers according to the present invention allow circulation of the electrolyte in the electrolyser and the internal degassing chamber by spontaneous convection, i.e. without pumping.

In still a further aspect, the high pressure electrolysers of the invention are provided with a supply system to replace the water that is consumed during the course of the electrolysis with minimal moving parts using the pressure of the gas that is liberated in the high pressure electrolyser module as driving force.

In addition to the above-mentioned advantages, the high pressure electrolyser modules of the invention can be allowed to cool to room temperature when they are not functioning. Art-known electrolysers typically function at elevated temperatures, e.g. at 70° C., and show leakage when allowed to cool. Consequently, even when out of function, they have to be kept at this elevated temperature.

In a further aspect the invention concerns an electrolyser comprising an electrolyser module as described herein.

In a further aspect the invention concerns a frame for an electrolyser module comprising:

(a) a body;

(b) at least one electrolyser chamber opening defined in said body;

(c) at least one degassing chamber opening defined in said body; and (d) at least one separated gas opening defined in said body to facilitate removal of gas separated from the gas and liquid mixture disposed in said at least one degassing chamber.

In a further aspect the invention concerns a frame for an electrolyser module comprising:

(e) a body;

(f) at least one electrolyser chamber opening defined in said body;

(g) at least one degassing chamber opening defined in said body; and (h) at least one separated gas opening defined in said body to facilitate removal of gas separated from the gas and liquid mixture disposed in said at least one degassing chamber.

In a further aspect the invention concerns a frame for an electrolysis module, said frame comprising:

(i) a unitary body having a rounded peripheral shape;

(j) at least one electrolysis chamber opening defined in said body; and (k) at least one degassing chamber opening defined in said body, said degassing chamber opening having a rounded shape.

In a further aspect the invention concerns a frame for an electrolysis module, said frame comprising:

(l) a unitary body;

(m) at least one electrolysis chamber opening defined in said body, said electrolysis chamber opening having a rounded shape; and (n) at least one degassing chamber opening defined in said body, said degassing chamber opening having a rounded shape.

In a further aspect the invention concerns an electrolyser module comprising:

(o) a plurality of frames arranged together to form at least one electrolyser chamber and at least one degassing chamber, said degassing chamber having a rounded shape.

In a further aspect the invention concerns a holding frame for an electrolyser module, said frame having an opening that forms an electrolysis chamber, characterized in that the frames have one or more additional openings that form one or more degassing chambers, wherein the gas that is generated is collected and allowed to separate into a liquid and gas phase.

DETAILED DESCRIPTION OF THE INVENTION

The electrolysis chambers in the electrolyser modules according to the invention contain one or more, preferably two electrodes placed vertically in the chamber. The electrodes are made of art-known materials that are inert to the electrolyte. The chambers are separated by a semi-permeable membrane or diaphragm and where two electrodes per chamber are used, the electrodes are preferably pressed against the membrane or diaphragm and connected by a suitable conductor. In a preferred arrangement, a bipolar plate is placed between the two electrodes and electric contact is made by placing two metallic woven sheets between each electrode.

The various parts of each electrolysis chamber are held in a frame, i.e. the 'holding frame', which also forms the outer wall of the electrolysis chamber. As mentioned above, the holding frame may have various shapes, but preferably has a flat cylindrical (or ring) shape. In high pressure electrolyser modules, the holding frame is preferably ring shaped.

The electrolysis chambers are placed next to one another forming a stack of electrolysis chambers. Typically this stack is held together between two flanges, preferably made of metal, mounted at each side of the stack. The flanges are held together with several tie rods placed at the outside of the electrolyser module and linking the flanges fitted with bolds to turn tight to press the electrolysis chambers together.

The gasses that are generated in the electrolyser module contain electrolyte and typically a gas/electrolyte mixture is generated in the module that needs to be separated in a liquid and a gas phase. Therefore this mixture is led to degassing chambers where gas and electrolyte are separated. The degassing chambers in the electrolyser modules of the invention are positioned within the electrolyser module.

As used herein, the term 'gas that is generated' and similar terms, when used in relation to gas that is generated in the electrolyser module until it is separated in the internal degassing chambers, is meant to comprise the afore mentioned gas/electrolyte mixture.

The holding frames touch one another and the portion of the surface of the frames that is in contact with a neighboring frame is referred to as a connecting surface. The latter preferably is located at the portion of the frame close or next to the outer rim of the holding frame and is not interrupted. Where the holding frame is circular, e.g. ring-shaped the connecting surface usually is also circular, e.g. ring shaped. The term 'connecting surface' as used herein refers to the surface of the ring by which a particular ring-shaped frame is connected with a neighboring ring.

The connecting surface may be flat or, which is preferred, in particular in the instance of high pressure electrolyser modules, may have one or more elevations and/or depressions. The elevations and depressions may be of various shapes, for example block-shaped (i.e. square or rectangular) or triangular. The latter shape is preferred in particular in high pressure applications.

The elevation or elevations and/or depression or depressions are preferably positioned close to the outer rim of the holding frame. They may be positioned in a concentric manner, whereas a neighboring holding frame may contain one or more equal-sized and shaped depressions so that an elevation fits into a depression of a neighboring ring. Or a particular holding frame may have, at the connecting surface, one or more elevations and at the other surface one or more depressions. In another embodiment, a connecting surface may contain as well one or more elevations as depressions.

In particularly preferred embodiments, in particular those for functioning under high pressure, the connecting surface of the ring-shaped frame has a series of small elevations and depressions giving the surface a milled aspect, the elevations and depressions having a triangular shape, whereby a cross-section of the surface has a saw-tooth aspect. The distance between each elevation (and hence between each depression) may vary, for example it may be in the range of 0.5 to 3 mm, e.g. about 1 mm, and the distance between the top of an elevation and the bottom of a depression may vary too, for example it may be in the range high of 0.5 to 3 mm. In the holding frames for high pressure applications, the distance between each elevation (and hence between each depression) and the distance between the top of an elevation and the bottom of a depression will preferably be in these ranges.

Preferably, a gasket is placed in order to assure a better contact between the frames, reassuring a liquid and gas-tight connection between two holding frames. The gasket is made of a suitable material, inert to the used electrolyte.

In some embodiments, the connecting surface may have one depression in which a gasket may fit. Here the gasket preferably is a ring shaped gasket made of a suitable elastic material. In other embodiments, a gasket may be placed over a portion or over the complete connecting surface. In the latter instances a flat gasket preferably is used, and the connecting surface is provided with one or more elevations and depressions to improve liquid and gas tightness.

In embodiments for high pressure, the gasket is a flat ring made of a synthetic material, and is pressed between the milled surfaces of two neighboring frames. Such ring-shaped flat gasket preferably is made of a suitable elastic and inert polymeric material such as polytetrafluoroethylene and has a uniform thickness in the range of 0.2 to 1 mm, preferably about 0.5 mm. It preferably is sized equal to, or slightly smaller than the flat surface of the ring-shaped frame. In the latter instance the gasket's outer side lies within a small distance of the outer side of the frame, for example 2 mm. Preferably the flat gasket covers the surface formed by the elevations/depressions in the ring.

Preferably, and in particular in the executions for high pressure applications, the elevations/depressions cover about the whole connecting surface of the holding frame, preferably except for a small section at the outer and inner rims of the holding frame, in particular ending at least 2 or 3 mm from the holding frame's edge. In a particularly preferred embodiment, a series of elevations/depressions is positioned concentrically around the conduit openings. This embodiment allows an even more effective closure of the rings. The distance of the outer circle circumscribing the surface covered by these concentric elevations/depressions to the outer rim of the conduit opening is about half the diameter of the conduit opening.

The frame may have a varying thickness (i.e. distance between the two connecting surfaces of the ring). For example it may be in the range of 0.2 to 1.5 cm, in particular of 0.4 to 1.0 cm, preferably about 5 or about 6 mm.

In case of a high pressure electrolyser execution, the shape and dimensions of the holding frame are preferably selected to ensure high pressure electrolysis on the one hand and spontaneous convection of the electrolyte on the other.

The holding frame may have one but preferably at least two relatively small cylindrical shaped openings, herein also referred to as conduit openings, preferably at the bottom portion of the holding frame. In each holding frame, one bottom conduit opening is connected to the electrolysis chamber via a small cylindrically shaped connecting channel. In some embodiments, the holding frame may have two more similar conduit openings, which preferably are located at the top side of the frame. In each holding frame, one top opening is connected to one internal degassing chamber via a small cylindrically shaped connecting channel.

The holding frames will be arranged such that all the conduit openings are positioned next to one other thus forming conduits leading throughout the electrolyser module. Therefore, the conduit openings should be positioned in the connecting surface of the holding frame.

The said connecting channels should preferably have a small diameter, e.g. in the range of from 0.5 to 5 mm, more particularly from 0.5 to 3 mm, for example 1 or 2 mm. Preferably, the diameter of the connecting channel for electrolyte should be larger than that of the connecting channel for removal of gasses. In particular embodiments the diameter of the said conduits is about 1 mm for the connecting channels for gas, and about 2 mm for connecting channels for electrolyte. The length of said connecting channels may be in the range of from 1 cm to 4 cm, in particular from 2 cm to 3 cm, e.g. 2.5 cm.

In high pressure electrolyser executions, the distance between the rim of said conduit openings and the outer wall of the opening forming the gas or electrolyte conduit, and the outer wall of the ring-shaped frame is such that the material can endure a pressure gradient, e.g. a pressure gradient of at least 200 bar, said distance for example being at least 1.5 cm.

The holding frame further has a relatively larger opening which usually is circular and which forms the inner part of the electrolysis chambers. The diameter of this larger opening may vary depending on the desired volume of the electrolysis chambers and hence the scale of the electrolysis process. In a standard electrolyser module for industrial application the diameter of this larger opening may vary between 5 and 200 cm, in particular between 10 and 100 cm, preferably between 20 and 80 cm. Useful diameters are e.g. about 14, 20, 36 or 80 cm. The size of this larger opening often is expressed in terms of surface, i.e. the surface circumscribed by the larger opening. Expressed in this manner, particular inner sizes may vary between 20 and 10,000 $cm^2$, in particular between 100 and 5000 $cm^2$, more in particular between 150 and 5000 $cm^2$. Useful sizes are those of about 150 or 300 or 1000 or 5000 $cm^2$. For compact electrolysers, e.g. for home fueling applications the size will be about 150 to about 300 $cm^2$.

The said larger opening forming the inner part of the electrolysis chamber should be located preferably at the bottom portion of the holding frame, it should be located lower than the openings forming the degassing chambers.

The distance between the outer rim of the holding frame and the rim of the larger opening forming the inner part of the electrolysis chamber may vary but should be such that there is enough material between the outer wall of the holding frame and the wall of the larger opening, e.g. at least about one cm. Where the frames are meant for use in a high pressure electrolysis module should at least be such that it can resist the internal pressure of the module, e.g. it can be at least about 5 cm, more in particular at least about 7 cm, e.g. about 10 cm.

The holding frame additionally has at least one additional larger opening that forms the degassing chamber. The latter is connected to an electrolysis chamber and receives the gas-electrolyte mixture that is generated at the cathode and respectively the anode, e.g. in the case of electrolysis of water, a hydrogen-electrolyte and respectively oxygen-electrolyte mixture. There may be two types of degassing chambers, each for one gas-electrolyte mixture. In such executions there is a series of degassing chambers, which should be connected. Preferably there are two such openings so that upon stacking of the frames the two openings are positioned next to one another thus forming two continuous degassing chambers from one end of the electrolyser module to the other. These continuous degassing chambers receive the gas electrolyte mixture that is generated at the cathode and respectively the anode. The two degassing chambers therefore can be referred to as anodic and cathodic degassing chamber.

As mentioned previously, the opening or openings forming the degassing chamber or chambers should be positioned higher than the opening forming the electrolysis chamber. The opening or openings forming the degassing chamber or chambers may be positioned completely above the opening forming the electrolysis chamber, but this is not a requirement. At least the center point of the opening or openings forming the degassing chamber or chambers should be located higher than the center point of the opening forming the electrolysis chamber.

In each holding frame, one opening that forms a degassing chamber is connected to the opening forming the electrolysis chamber via a small channel that preferably is cylindrical. In executions with two degassing openings, only one is connected the other not. The gas-electrolyte mixture that is formed in the electrolysis chamber migrates through this channel to the degassing chamber where the degassing occurs and this channel additionally allows the degassed electrolyte to run back into the electrolysis chamber.

The size and shape of the openings that form the degassing chambers should be such that adequate degassing process can occur. The shape of these openings may vary, it can be circular resulting in a cylindrical internal degassing chamber, ellipsical or of any other shape. Rounded shapes, i.e. shapes without corners are preferred. A particular preferred shape is such that a maximal internal volume is created within the ring-shaped frame. The shape in particular is more or less 'lung'-like as pictured in the drawings accompanying this description. The size may also vary but typically the size of the opening forming the internal degassing chamber will be larger than that of the opening or openings forming the electrolyte conduit or conduits. Preferably the size is selected such that the volume of the degassing chambers is about equal to the volume of the electrolysis chambers.

The internal degassing chambers are connected to a storage tank outside the electrolyser module. This connection can be for example by a channel in one or more of the frames that leads to external piping, which is in connection with the storage tank. In a preferred execution the holding frame has two more openings forming two additional conduits throughout the electrolyser module, which conduit openings are connected to the openings forming the degassing chambers through small channels.

Thus in preferred executions, there are four smaller openings forming conduits, and the center of each such opening may be more preferably located on an imaginary circle concentric to the outer rim, and the openings may still more preferably be positioned symmetrically. In these executions, each holding frame has two upper openings and two bottom openings. The top openings serve as conduits to remove the gasses that come from the degassing chambers. The bottom openings serve as a conduit for the supply of water or electrolyte.

In particularly preferred embodiments, a holding frame has two top openings of which one is connected to one degassing chamber and the other to the other degassing chamber and two bottom openings of which one is connected to the inner rim of the ring, the openings being positioned symmetrically on the ring and wherein the openings having the small conduit connection are positioned at the same half of the ring. This particular embodiment of the holding frame allows stacking with only this frame type.

The conduit openings are circular shaped having a diameter in the range of from 1.0 cm to 3.0 cm, in particular in the range of from 1.5 cm to 2.5 cm, for example about 2.0 cm.

The ring-shaped rings are stacked in such manner that all conduit openings fit precisely on one another thus forming a channel which passes through the whole of the electrolyser module.

The outer diameter of the holding frame depends on the size of the openings in the frame, in particular of the size of the opening forming the inner part of the electrolysis chambers and of the positioning of the various openings in the frame.

The holding frames preferably are made of a suitable polymeric material that is inert to the electrolyte, and more preferably is a thermoplastic material such as polyphenylene sulphide, polyphenylene oxide and the like and in particular polysulphone. The holding frames may be manufactured by conventional molding techniques. Thus, the holding frames are preferably formed with unitary or integral bodies.

In the high pressure electrolyser modules, the distance between the outer wall of the holding frame and the rim of the various openings in the frame, must be sufficient such that the section of the ring covered by said distance can endure the pressure gradient between the inner space of the electrolyser module and the atmospheric pressure outside the electrolyser module. The various openings comprise the larger opening forming the electrolysis chambers, the smaller opening or openings forming the conduits for water and electrolyte supply, the openings forming the degassing chambers and openings forming conduits for removing gas from the degassing chambers. In particular said distance is at least 1.5 cm, more particularly at least 2 cm or at least 3 cm. In the instance where the electrolyser functions at about 200 bar a distance of about 2 cm proved out to be effective.

When the openings in the ring frame are shaped and positioned in the manner described as for high pressure executions, quite unexpectedly it has been found that the electrolyte-gas mixture is circulated in the electrolyser module and de-gassing unit by spontaneous convection, i.e. without the help of a pumping system.

The compact electrolyser modules according to this invention may be used under high pressure. If set up as outlined herein they can resist pressures as high as 200 Bar, even up to 300 Bar. Pressures typically used to compress gasses such as hydrogen or oxygen, e.g. 200 Bar are quite feasible. This allows electrolysis under increased pressure whereby the gasses that are produced need not be compressed. This allows a more simple arrangement in that on the one hand a gas compressor and on the other a pump needed to circulate the electrolyte can be omitted.

In still a further aspect, there is provided a high pressure electrolyser according to the invention, having a water-supply system, placed above a degassing chamber, comprising a vessel having an inlet for water and an inlet for pressurized gas that is tapped from one of the degassing units, and an outlet for water brought at high pressure into a pipe that is connected to one of the de-gassing chambers. The water-supply system has minimal moving parts and is placed above the electrolyser module, in particular above the degassing units. It comprises a vessel preferably made of metal and capable of resisting the pressure at which the electrolyser functions, having an inlet for water and an inlet for pressurized gas that is tapped from one of the degassing units. Water is allowed to enter the said vessel, e.g. by a suitable tap, and subsequently pressurized gas is entered. In this manner the water brought at high pressure and subsequently this water is allowed to leave the vessel, e.g. by a tap, into a pipe that is connected to one of the de-gassers, the water flowing into the de-gasser by gravity. The present system is simple, requiring no additional pumps thereby avoiding moving parts. The taps can be controlled manually or their functioning can be automated.

In a preferred embodiment, in case of electrolysis of water, use is made of the pressurized oxygen that is separated in the oxygen degassing unit and the water-supply system is connected to the oxygen separating chamber.

The present electrolysers can be used in the production of various gasses, for example chlorine by the electrolysis of brine, or oxygen and hydrogen in case of the electrolysis of water.

The following is a detailed description of the drawings meant to illustrate the invention and not to limit it thereto.

FIG. 1 shows a cross-section of a high pressure electrolyser module according to the present invention.

FIG. 2*a* is a front view of a ring-shaped frame with two openings for a degassing chamber.

FIG. 2*b* is a front view of a ring-shaped frame with one opening for a degassing chamber.

FIG. 2*c* is a front view of a ring-shaped frame with one opening for a degassing chamber.

FIG. 2*d* is a perspective view of a number of ring-shaped frames with two openings for a degassing chamber.

Figure 1:
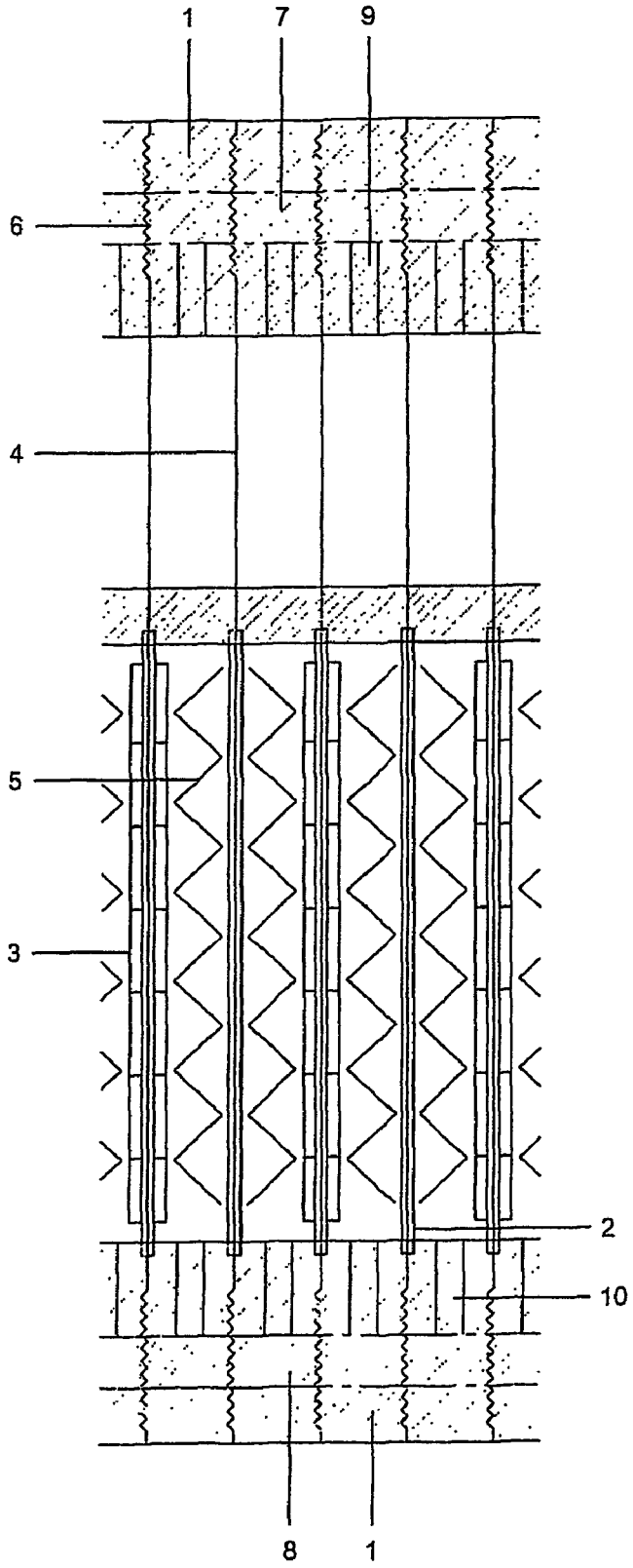

FIG. 1 shows a cross section of a number of electrolysis chambers being held in frame 1, being separated by membrane 2 to which the electrodes 3 are pressed. The electrodes are electrically connected to the bipolar plate 4 with a metal woven sheet 5. The frame has the larger conduit openings 7 on the top side and 8 on the bottom side. Conduit openings 7 evacuate the gas that is generated and openings 8 form a supply channel of electrolyte. Opening 7 is connected to the electrolyser module's inner space with the small connecting conduit 9 and similarly opening 8 is connected to the inner space via small connecting conduit 10.

Figure 2A:
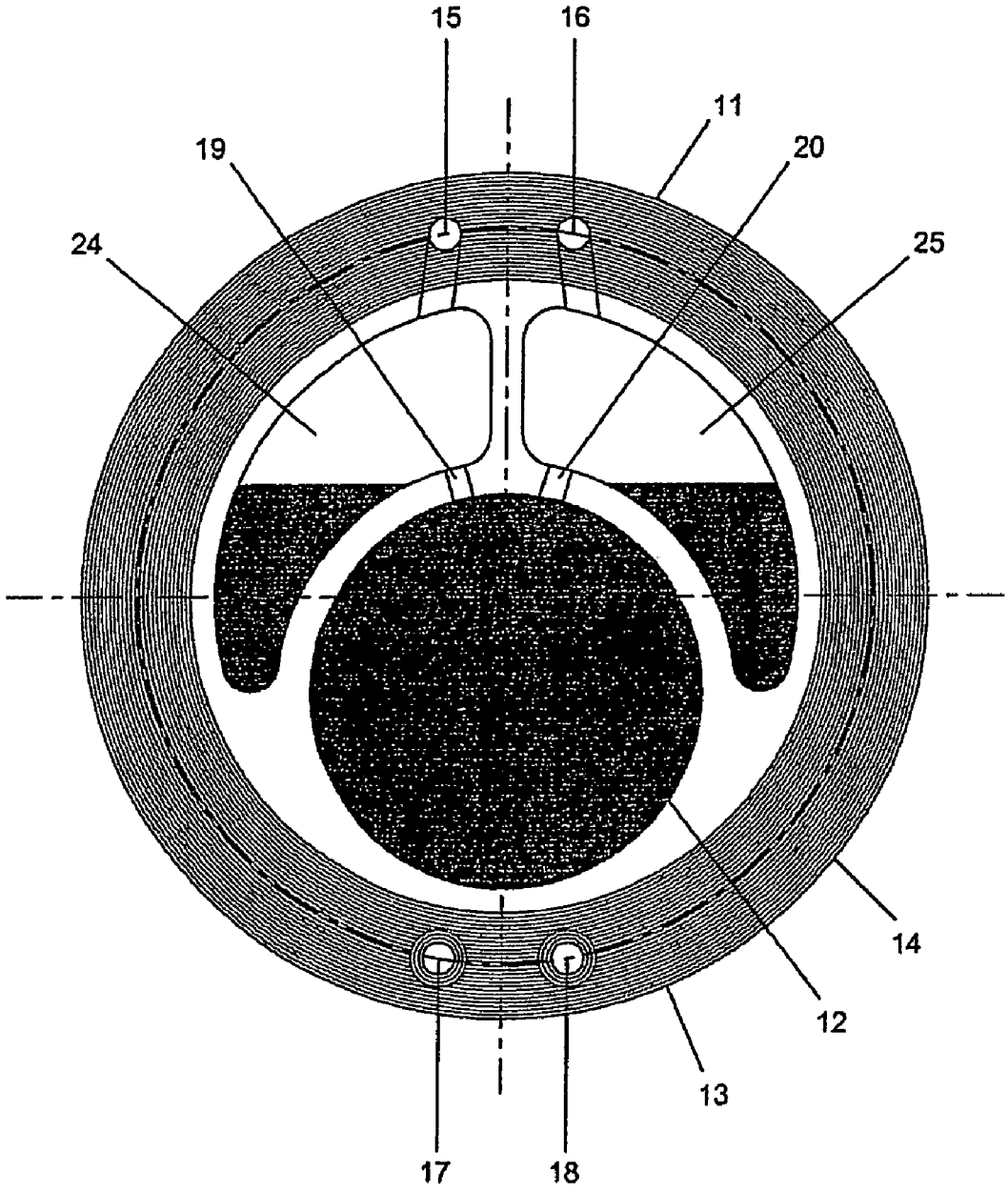
Figure 2B:
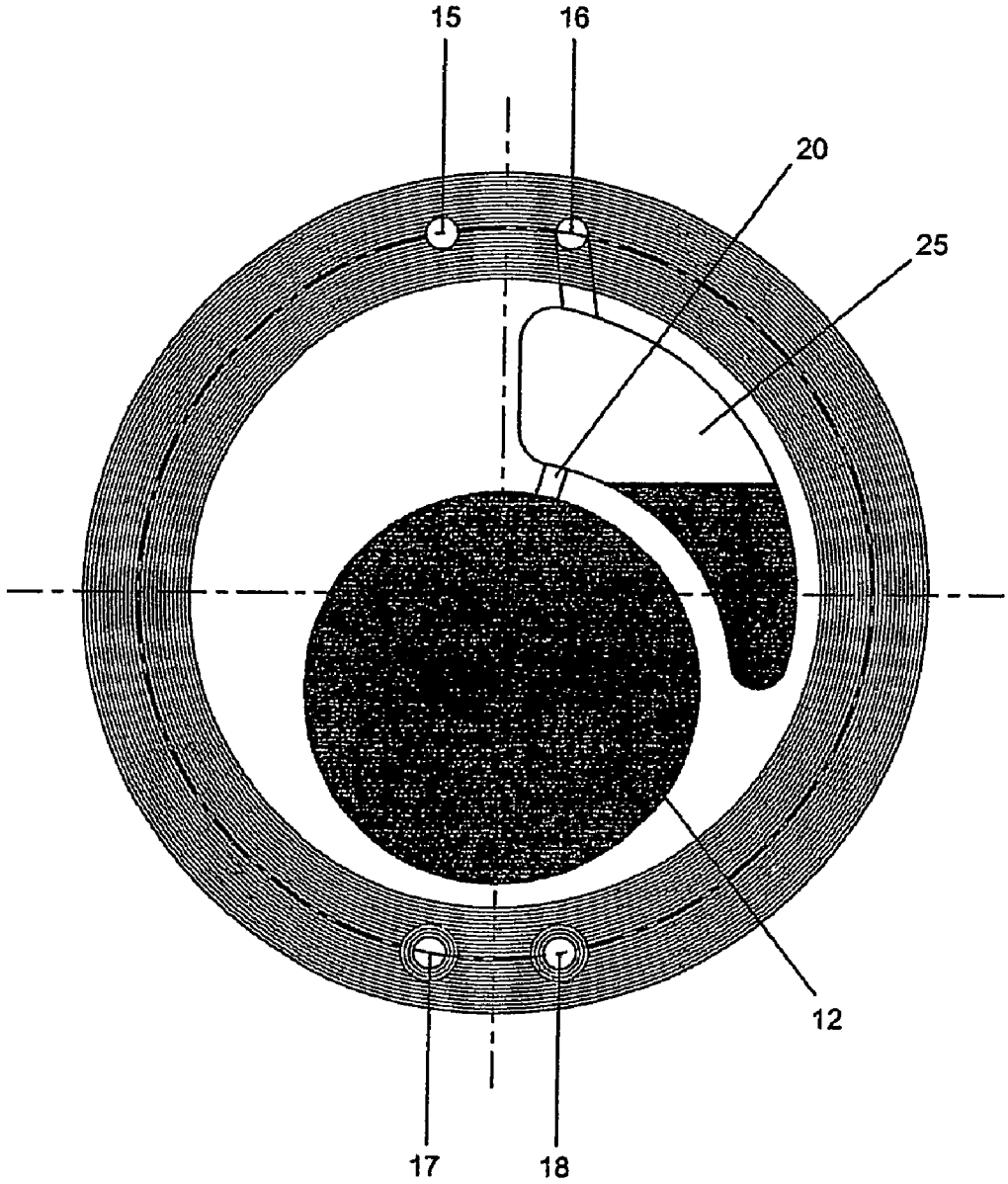
Figure 2C:
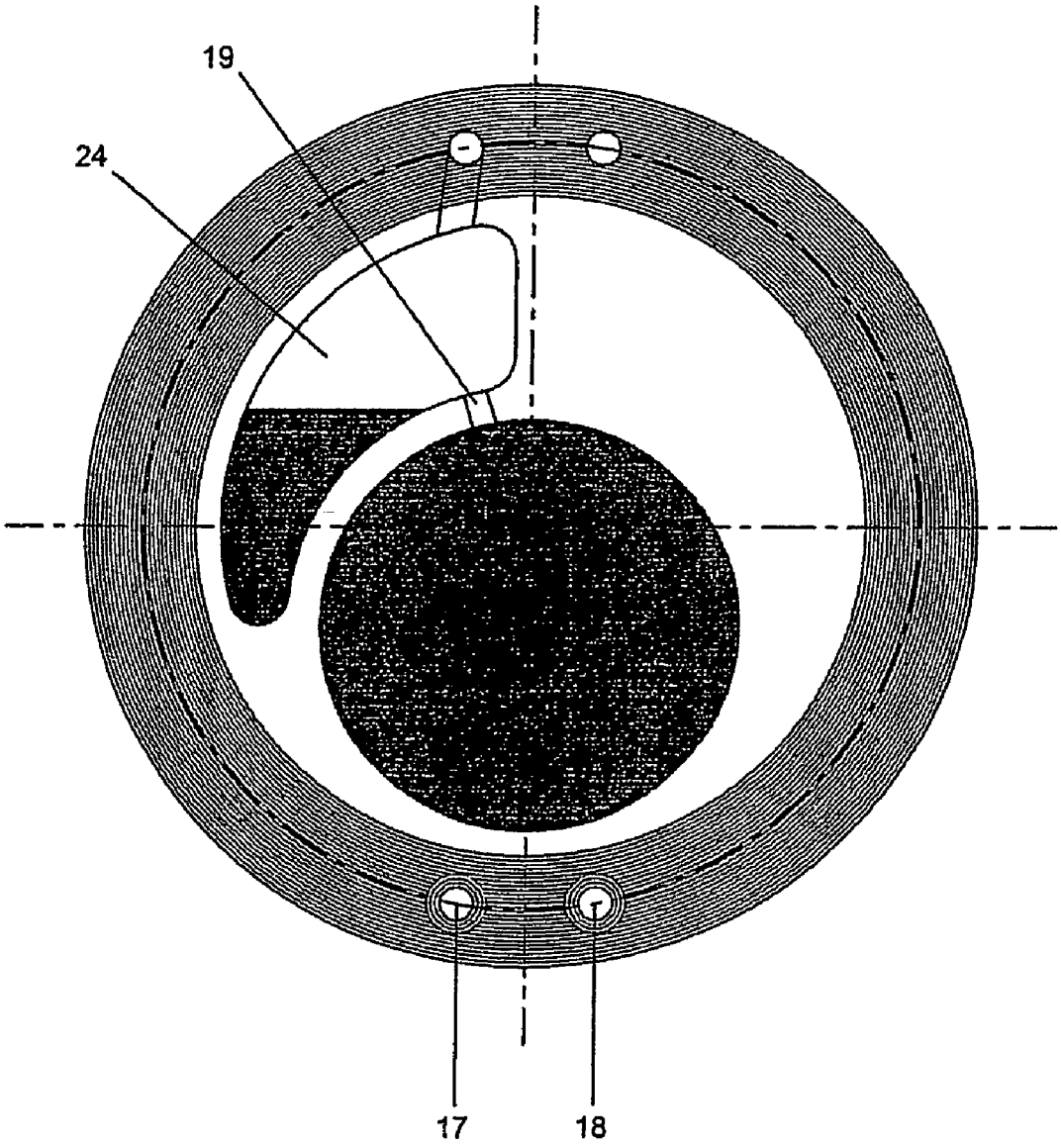
Figure 2D:
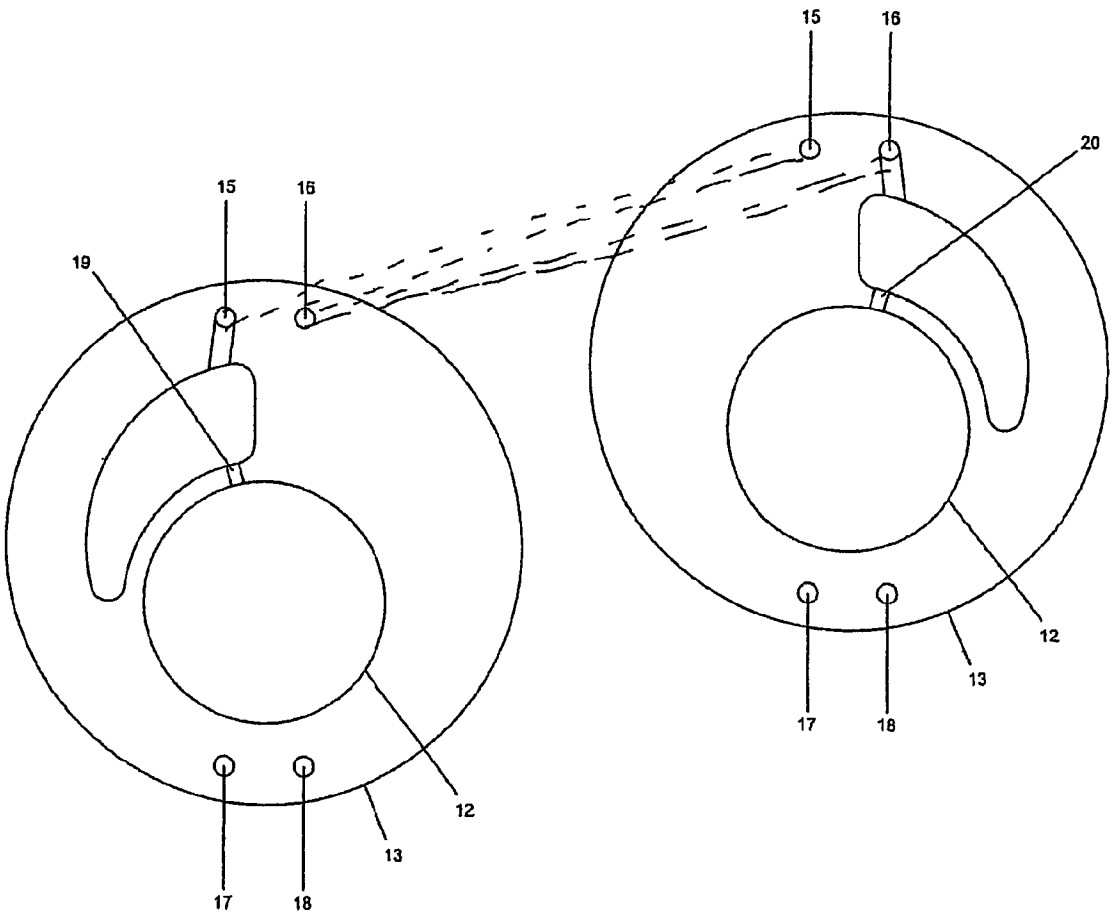

A front view of the ring-shaped frame with two openings for a degassing chamber is shown in FIGS. 2*a* and 2*d*, and the alternative execution with one opening for a degassing chamber in FIGS. 2*b*, and 2*c*. The figures show the connecting surface 11, the opening for the electrolysis chamber 12 and the outer rim 13, the openings for the degassing chambers 24 and 25, the milled surface 14 and the top conduit openings 15 and 16; and the bottom conduit openings 17 and 18. In this embodiment, top opening 16 is connected to the opening for degassing chamber 25, whereas top opening 15 is connected to the opening for degassing chamber 24 by connecting channels 19 and 20. The centers of the four ring openings are located on concentric circle 23.

Axis 21 crosses the center of the ring-shaped frame, said center also being located on the crossing of intersecting axes 22. The milled surface concentric to the ring openings 15, 16, 17 and 18 is represented by 24, the surface of the latter milled surface depending upon the distance between the outer rim 26 of the opening and the outer rim of the concentric milled surface 24.

Figure 3:
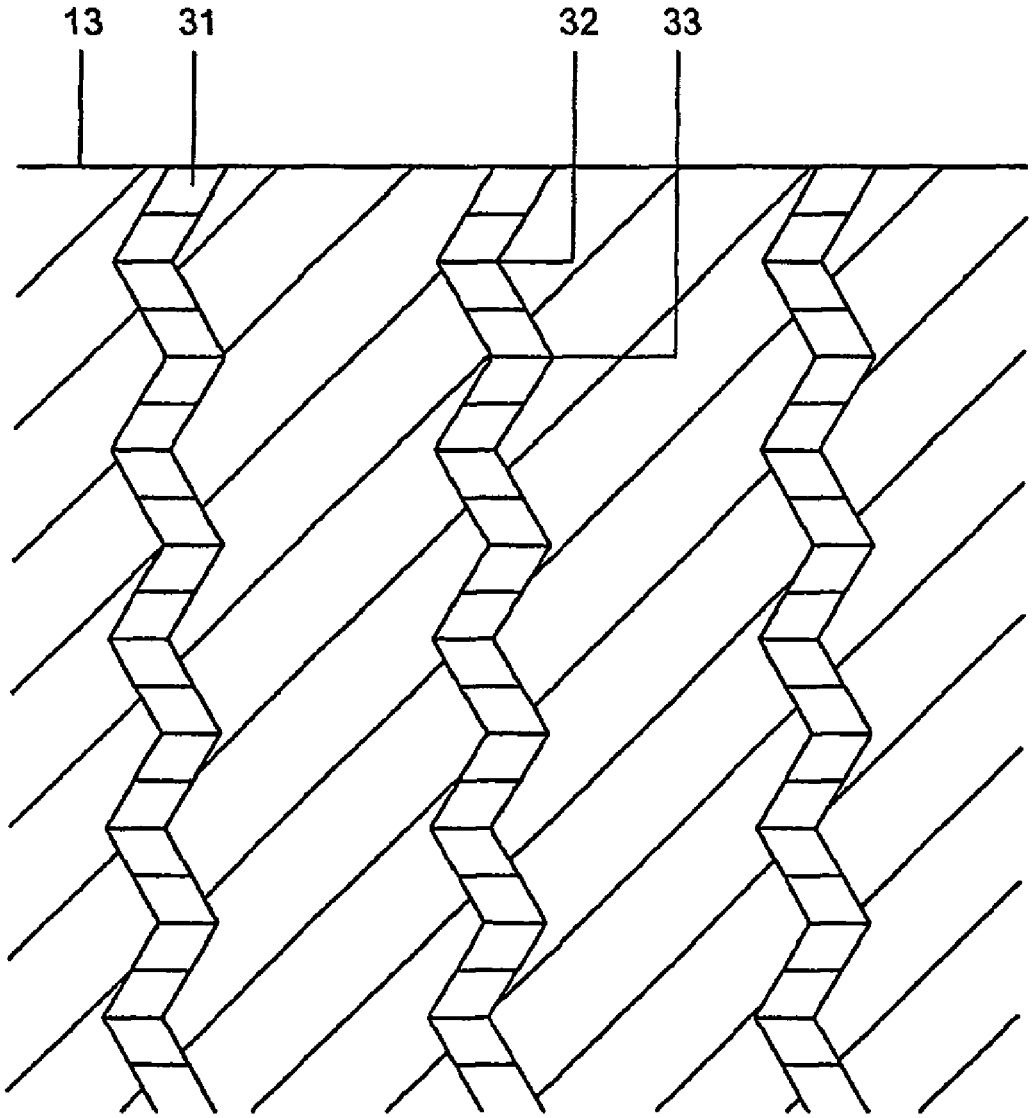
FIG. 3 shows a cross section of a number of connected ring-shaped frames.

FIG. 3 shows a cross-section of the outer section of a number of holding frames 34 with the milled surface 14 and the elevations 33 and depressions 32 giving the cross-section of the ring a saw-tooth aspect. 13 is the outer rim of the holding frame and 31 is the gasket.

Figure 4:
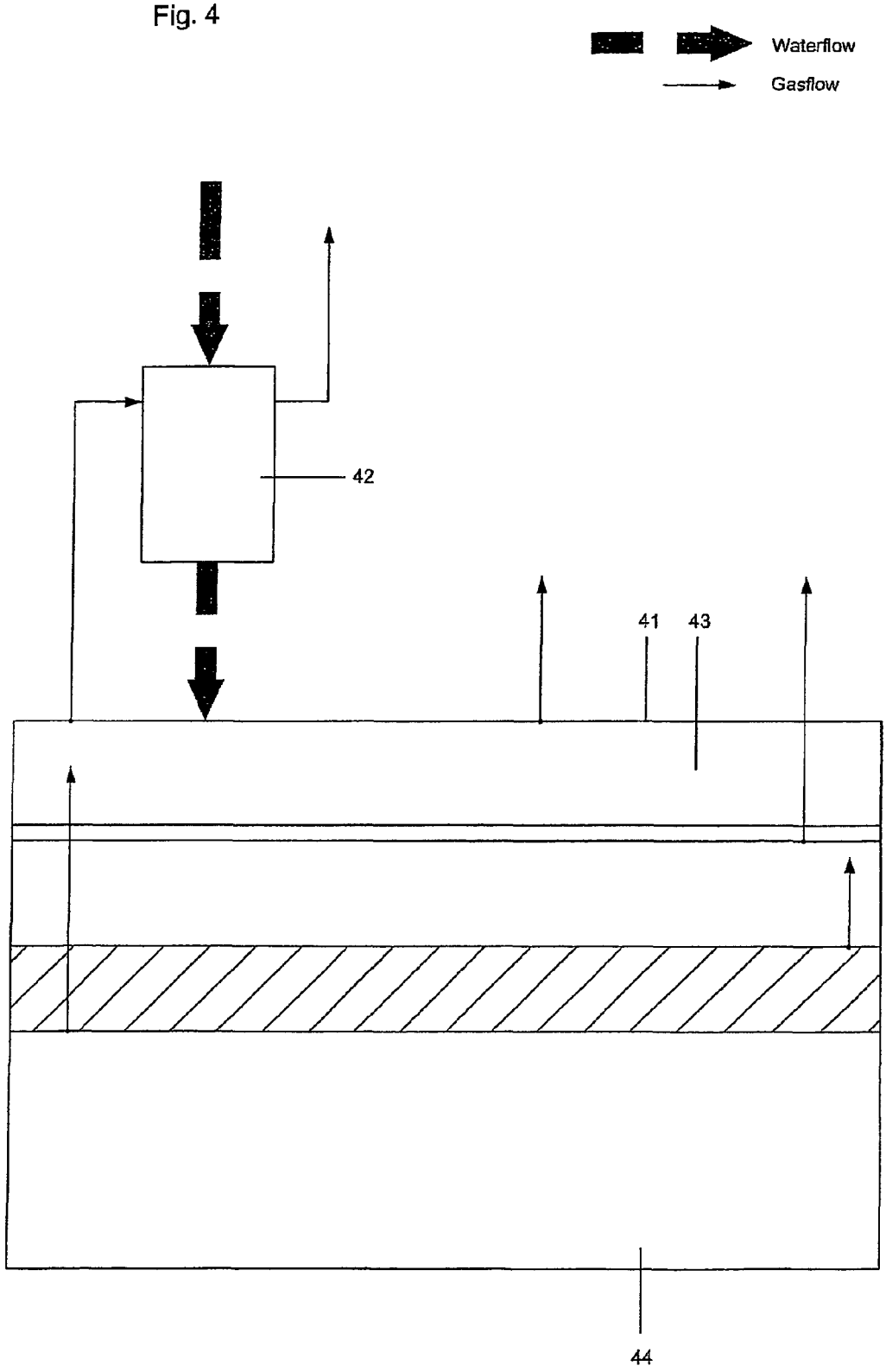
FIG. 4 shows a schematic representation of an electrolyser with two degassing chambers and a water supply system.

FIG. 4 shows a schematic representation of the major part of a high pressure electrolyser according to the invention, wherein 41 represents the electrolyser module with the internal degassing chambers 43 and 44 and the higher placed water-supply system 42. The gas/electrolyte mixture that is generated in electrolyser module 41 is lead to degassing chambers 43 and 44. One of said de-gassing chambers, in particular the oxygen degassing chamber in case of electrolysis of water, is connected to a water-supply system 42, wherein water is pressurized with the oxygen gas coming from chamber 43. Pressured water of 42 is led into chamber 43 by gravity, hence no extra pump is required to supply fresh water.

The above-described embodiments of the invention are intended to be examples of the present invention, and alterations and modifications may be effected thereto, by those of skill in the art, without departing from the scope of the invention which is defined solely by the claims appended hereto.

The invention claimed is:

1. A frame for an electrolyser module comprising:

(a) a body;

(b) at least one electrolyser chamber opening defined in said body;

(c) at least one degassing chamber opening defined in said body; and (d) at least one separated gas opening defined in said body to facilitate removal of gas separated from the gas and liquid mixture disposed in said at least one degassing chamber.

2. A frame as claimed in claim 1 wherein said degassing chamber opening is lung-shaped.

3. A frame as claimed in claim 1 wherein said degassing chamber opening is circular.

4. A frame as claimed in claim 1 wherein said degassing chamber opening is elliptical.

5. A frame as claimed in claim 1 wherein said electrolysis chamber opening is circular.

6. A frame as claimed in claim 5 wherein said body has a rounded peripheral shape.

7. A frame as claimed in claim 1 wherein said body has a circular peripheral shape.

8. A frame as claimed in claim 1 wherein said body has a first side that is generally flat and an opposing second side that is generally flat.

9. A frame as claimed in claim 8 wherein said first side defines a first connecting surface and said second side defines a second connecting surface.

10. A frame as claimed in claim 9 wherein said first connecting surface and said second connecting surface have corresponding connecting structures to facilitate the first connecting surface of one said frame connecting with the second connecting surface of a corresponding one of said frames.

11. A frame as claimed in claim 10 wherein said connecting structures comprise corresponding elevations and depressions defined in said first and second connecting surfaces.

12. A frame as claimed in claim 11 wherein said elevations and depressions have corresponding block shapes.

13. A frame as claimed in claim 11 wherein said elevations and depressions have corresponding triangular shapes.

14. A frame as claimed in claim 1 wherein said first and second connecting surfaces are adapted to receive a sealing gasket between adjacent connected frames.

15. A frame as claimed in claim 1 further comprising at least one electrolyte conduit opening defined in said body.

16. A frame as claimed in claim 1 further comprising at least one separated gas conduit opening defined in said body.

17. A frame as claimed in claim 16 further comprising a separated gas connecting channel defined in said body for connecting said at least one degassing chamber opening to said at least one separated gas conduit opening.

18. A frame as claimed in claim 1 further comprising an electrolysis connecting channel defined in said body for connecting said at least one electrolysis chamber opening to said at least one degassing chamber opening.

19. A frame as claimed in claim 1 wherein at least a portion of said at least one degassing chamber opening is positioned above said at last one electrolysis chamber opening.

20. A frame as claimed in claim 1 wherein the surface area of said at least one degassing chamber opening is equal to or greater than the surface area of said at least one electrolysis chamber opening.

21. An electrolyser module comprising a plurality of frames as claimed in claim 1, wherein said frames are connected together to define at least one electrolysis chamber and at least one degassing chamber, said degassing chamber having a rounded shape.

22. A frame for an electrolysis module, said frame comprising:

(a) a unitary body having a rounded peripheral shape;

(b) at least one electrolysis chamber opening defined in said body; and (c) at least one degassing chamber opening defined in said body, said degassing chamber opening having a rounded shape.

23. A frame as claimed in claim 22, wherein said frame has an opening that forms an electrolysis chamber, characterized in that the frames have one or more additional openings that form one or more degassing chambers, wherein the gas that is generated is collected and allowed to separate into a liquid and gas phase, and further having two additional openings that form conduits for the removal of the gasses that are separated off in the internal degassing chambers.

24. A frame as claimed in claim 22 wherein said degassing chamber opening is lung-shaped.

25. A frame as claimed in claim 22 wherein said degassing chamber opening is circular.

26. A frame as claimed in claim 22 wherein said degassing chamber opening is elliptical.

27. A frame as claimed in claim 22 wherein said electrolysis chamber opening is circular.

28. A frame as claimed in claim 27 wherein said body has a rounded peripheral shape.

29. A frame as claimed in claim 22 wherein said body has a circular peripheral shape.

30. A frame as claimed in claim 22 wherein said body has a first side that is generally flat and an opposing second side that is generally flat.

31. A frame as claimed in claim 30 wherein said first side defines a first connecting surface and said second side defines a second connecting surface.

32. A frame as claimed in claim 31 wherein said first connecting surface and said second connecting surface have corresponding connecting structures to facilitate the first connecting surface of one said frame connecting with the second connecting surface of a corresponding one of said frames.

33. A frame as claimed in claim 32 wherein said connecting structures comprise corresponding elevations and depressions defined in said first and second connecting surfaces.

34. A frame as claimed in claim 33 wherein said elevations and depressions have corresponding block shapes.

35. A frame as claimed in claim 33 wherein said elevations and depressions have corresponding triangular shapes.

36. A frame as claimed in claim 35 wherein said first and second connecting surfaces are adapted to receive a sealing gasket between adjacent connected frames.

37. A frame as claimed in claim 31 further comprising a separated gas connecting channel defined in said body for connecting said at least one degassing chamber opening to said at least one separated gas conduit opening.

38. A frame as claimed in claim 22 further comprising at least one electrolyte conduit opening defined in said body.

39. A frame as claimed in claim 22 further comprising at least one separated gas conduit opening defined in said body.

40. A frame as claimed in claim 22 further comprising an electrolysis connecting channel defined in said body for connecting said at least one electrolysis chamber opening to said at least one degassing chamber opening.

41. A frame as claimed in claim 22 wherein at least a portion of said at least one degassing chamber opening is positioned above said at last one electrolysis chamber opening.

42. A frame as claimed in claim 22 wherein the surface area of said at least one degassing chamber opening is equal to or greater than the surface area of said at least one electrolysis chamber opening.

43. An electrolyser module comprising a plurality of frames as claimed in claim 22, wherein said frames are connected together to define at least one electrolysis chamber and at least one degassing chamber, said degassing chamber having a rounded shape.

44. A frame as claimed in claim 22, wherein said frame has an opening that forms an electrolysis chamber, characterized in that the frames have one or more additional openings that form one or more degassing chambers, wherein the gas that is generated is collected and allowed to separate into a liquid and gas phase, and further having two additional openings that form conduits for the removal of the gasses that are separated off in the internal degassing chambers.

45. A frame for an electrolysis module, said frame comprising:

(a) a unitary body;

(b) at least one electrolysis chamber opening defined in said body, said electrolysis chamber opening having a rounded shape; and (c) at least one degassing chamber opening defined in said body, said degassing chamber opening having a rounded shape.

46. A frame as claimed in claim 45 wherein said degassing chamber opening is lung-shaped.

47. A frame as claimed in claim 45 wherein said degassing chamber opening is circular.

48. A frame as claimed in claim 45 wherein said degassing chamber opening is elliptical.

49. A frame as claimed in claim 45 wherein said electrolysis chamber opening is circular.

50. A frame as claimed in claim 45 wherein said body has a rounded peripheral shape.

51. A frame as claimed in claim 50 wherein said body has a circular peripheral shape.

52. A frame as claimed in claim 45 wherein said body has a first side that is generally flat and an opposing second side that is generally flat.

53. A frame as claimed in claim 45 wherein said first side defines a first connecting surface and said second side defines a second connecting surface.

54. A frame as claimed in claim 53 wherein said first connecting surface and said second connecting surface have corresponding connecting structures to facilitate the first connecting surface of one said frame connecting with the second connecting surface of a corresponding one of said frames.

55. A frame as claimed in claim 53 wherein said connecting structures comprise corresponding elevations and depressions defined in said first and second connecting surfaces.

56. A frame as claimed in claim 55 wherein said elevations and depressions have corresponding block shapes.

57. A frame as claimed in claim 55 wherein said elevations and depressions have corresponding triangular shapes.

58. A frame as claimed in claim 57 wherein said first and second connecting surfaces are adapted to receive a sealing gasket between adjacent connected frames.

59. A frame as claimed in claim 58 further comprising at least one electrolyte conduit opening defined in said body.

60. A frame as claimed in claim 45 further comprising at least one separated gas conduit opening defined in said body.

61. A frame as claimed in claim 60 further comprising a separated gas connecting channel defined in said body for connecting said at least one degassing chamber opening to said at least one separated gas conduit opening.

62. A frame as claimed in claim 45 further comprising an electrolysis connecting channel defined in said body for connecting said at least one electrolysis chamber opening to said at least one degassing chamber opening.

63. A frame as claimed in claim 45 wherein at least a portion of said at least one degassing chamber opening is positioned above said at last one electrolysis chamber opening.

64. A frame as claimed in claim 45 wherein the surface area of said at least one degassing chamber opening is equal to or greater than the surface area of said at least one electrolysis chamber opening.

65. An electrolyser module comprising a plurality of frames as claimed in claim 45, wherein said frames are connected together to define at least one electrolysis chamber and at least one degassing chamber, said degassing chamber having a rounded shape.

66. A holding frame for an electrolyser module as claimed in claim 45, wherein said frame having an opening that forms an electrolysis chamber, characterized in that the frames have one or more additional openings that form one or more degassing chambers, wherein the gas that is generated is collected and allowed to separate into a liquid and gas phase, and further having two additional openings that form conduits for the removal of the gasses that are separated off in the internal degassing chambers.

* * * * *